US011656563B2

(12) United States Patent
Miyamoto et al.

(10) Patent No.: US 11,656,563 B2
(45) Date of Patent: May 23, 2023

(54) JACKET, TRANSFER DEVICE, AND IMAGE FORMING DEVICE

(71) Applicant: FUJIFILM Business Innovation Corp., Tokyo (JP)

(72) Inventors: Yoko Miyamoto, Ebina (JP); Hirotaka Tanaka, Ebina (JP); Kazuyoshi Hagiwara, Ebina (JP); Kei Tanaka, Ebina (JP); Tomoaki Yoshioka, Ebina (JP); Toshiaki Baba, Ebina (JP); Koichiro Yuasa, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/552,071

(22) Filed: Dec. 15, 2021

(65) Prior Publication Data

US 2022/0107591 A1 Apr. 7, 2022

Related U.S. Application Data

(63) Continuation of application No. PCT/JP2020/019966, filed on May 20, 2020.

(30) Foreign Application Priority Data

Aug. 14, 2019 (JP) ..... JP2019-148712

(51) Int. Cl.
*G03G 15/16* (2006.01)
*G03G 15/00* (2006.01)
(Continued)

(52) U.S. Cl.
CPC ..... *G03G 15/162* (2013.01); *G03G 15/0131* (2013.01); *G03G 15/165* (2013.01);
(Continued)

(58) Field of Classification Search
CPC ..... G03G 15/0131; G03G 15/162; G03G 15/165; G03G 15/1655; G03G 15/167;
(Continued)

(56) References Cited

U.S. PATENT DOCUMENTS 4,974,027 A 11/1990 Landa et al.
4,984,025 A 1/1991 Landa et al.
(Continued)

FOREIGN PATENT DOCUMENTS

JP H01-83575 U 6/1989
JP H09-50191 A 2/1997
(Continued)

OTHER PUBLICATIONS

Jul. 14, 2020 International Search Report issued in International Application No. PCT/JP2020/019966.
(Continued)

*Primary Examiner* — Joseph S Wong
(74) *Attorney, Agent, or Firm* — Oliff PLC

(57) ABSTRACT

A jacket includes: a first layer that is on a cylinder body side when the jacket is attached to a rotating cylinder body; and a second layer that is a layer located on a side opposite to the cylinder body with respect to the first layer, has a hardness lower than that of the first layer, and does not exist at a position where at least one of end edges of the cylinder body in a rotation axis direction is located inward of the first layer in the rotation axis direction.

20 Claims, 4 Drawing Sheets

(51) Int. Cl.
*G03G 15/01* (2006.01)
*G03G 21/16* (2006.01)

(52) U.S. Cl.
CPC ..... *G03G 15/167* (2013.01); *G03G 15/1655* (2013.01); *G03G 15/1685* (2013.01); *G03G 15/657* (2013.01); *G03G 15/6529* (2013.01); *G03G 15/6558* (2013.01); *G03G 21/168* (2013.01); *G03G 2215/00379* (2013.01); *G03G 2215/00409* (2013.01); *G03G 2215/00413* (2013.01)

(58) Field of Classification Search
CPC ..... G03G 15/1685; G03G 15/6529; G03G 15/6558; G03G 15/657; G03G 21/168; G03G 2215/00379; G03G 2215/00409; G03G 2215/00413
See application file for complete search history.

(56) References Cited

U.S. PATENT DOCUMENTS

| | | | | |
|---|---|---|---|---|
| 4,999,677 | A | | 3/1991 | Landa et al. |
| 5,028,964 | A | | 7/1991 | Landa et al. |
| 5,047,808 | A | | 9/1991 | Landa et al. |
| 5,089,856 | A | | 2/1992 | Landa et al. |
| 5,276,492 | A | | 1/1994 | Landa et al. |
| 5,335,054 | A | | 8/1994 | Landa et al. |
| 5,410,392 | A | | 4/1995 | Landa |
| 5,497,222 | A | | 3/1996 | Landa et al. |
| 5,555,185 | A | | 9/1996 | Landa |
| 5,572,274 | A | | 11/1996 | Lior et al. |
| 5,636,349 | A | | 6/1997 | Landa et al. |
| 5,745,829 | A | | 4/1998 | Gazit et al. |
| 5,815,783 | A | | 9/1998 | Lior et al. |
| 5,907,998 | A | | 6/1999 | DeMoore et al. |
| 5,923,929 | A | | 7/1999 | Ben Avraham et al. |
| 6,070,042 | A | | 5/2000 | Landa et al. |
| 6,151,477 | A | * | 11/2000 | Takeuchi ..... G03G 15/1685 399/303 |
| 6,244,178 | B1 | | 6/2001 | DeMoore et al. |
| 6,969,543 | B1 | | 11/2005 | Aronhime et al. |
| RE39,305 | E | | 9/2006 | DeMoore et al. |
| 2001/0032560 | A1 | | 10/2001 | Andrew et al. |
| 2005/0049127 | A1 | * | 3/2005 | Nagata ..... G03G 15/0818 492/30 |
| 2005/0098051 | A1 | | 5/2005 | Flint et al. |
| 2005/0241503 | A1 | | 11/2005 | Hoffmann et al. |
| 2013/0189003 | A1 | * | 7/2013 | Yu ..... G03G 15/0189 399/313 |

FOREIGN PATENT DOCUMENTS

| | | | |
|---|---|---|---|
| JP | H10-510063 | A | 9/1998 |
| JP | 2003-527985 | A | 9/2003 |
| JP | 2004-171022 | A | 6/2004 |
| JP | 2005-246978 | A | 9/2005 |
| JP | 2007-510564 | A | 4/2007 |
| JP | 2008-310362 | A | 12/2008 |

OTHER PUBLICATIONS

Jul. 14, 2020 Written Opinion issued in International Application No. PCT/JP2020/019966.

* cited by examiner

JACKET, TRANSFER DEVICE, AND IMAGE FORMING DEVICE

CROSS-REFERENCE TO RELATED APPLICATIONS

This is a continuation of International Application No. PCT/JP2020/019966 filed on May 20, 2020, and claims priority from Japanese Patent Application No. 2019-148712 filed on Aug. 14, 2019.

BACKGROUND

Technical Field

The present disclosure relates to a jacket, a transfer device, and an image forming device.

Related Art

A technique of winding a replaceable jacket around a transfer cylinder and transferring an image onto a sheet passing over the jacket is considered.

Patent Literature 1 discloses an intermediate transfer member in which a replaceable sheet-shaped bracket is wound around a drum corresponding to a transfer cylinder to transfer a toner layer onto the bracket.

CITATION LIST

Patent Literature

Patent Literature 1: JP-A-2004-171022

SUMMARY

In the bracket in Patent Literature 1 described above, a toner image is directly transferred onto the bracket, and the toner image transferred onto the bracket is further transferred onto another member from the bracket. On the other hand, here, a sheet is placed on a jacket (bracket), and an image such as the toner image is to be formed on the sheet.

Although the bracket in Patent Literature 1 is attached to and detached from the drum, Patent Literature 1 does not refer to workability in attachment and detachment.

Aspects of non-limiting embodiments of the present disclosure relate to providing a jacket having improved workability in attachment and detachment as compared with a jacket in which an end edge of a layer having high hardness is exposed, and a transfer device and an image forming device including the jacket.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a jacket including:

a first layer that is on a cylinder body side when the jacket is attached to a rotating cylinder body; and a second layer that is a layer located on a side opposite to the cylinder body with the first layer interposed therebetween, has a hardness lower than that of the first layer, and does not exist at a position where at least one of end edges of the body in a rotation axis direction is located inward of the first layer in the rotation axis direction.

BRIEF DESCRIPTION OF DRAWINGS

Exemplary embodiment(s) of the present invention will be described in detail based on the following figures, wherein.

DETAILED DESCRIPTION

Hereinafter, exemplary embodiments of the present disclosure will be described.

Figure 1:
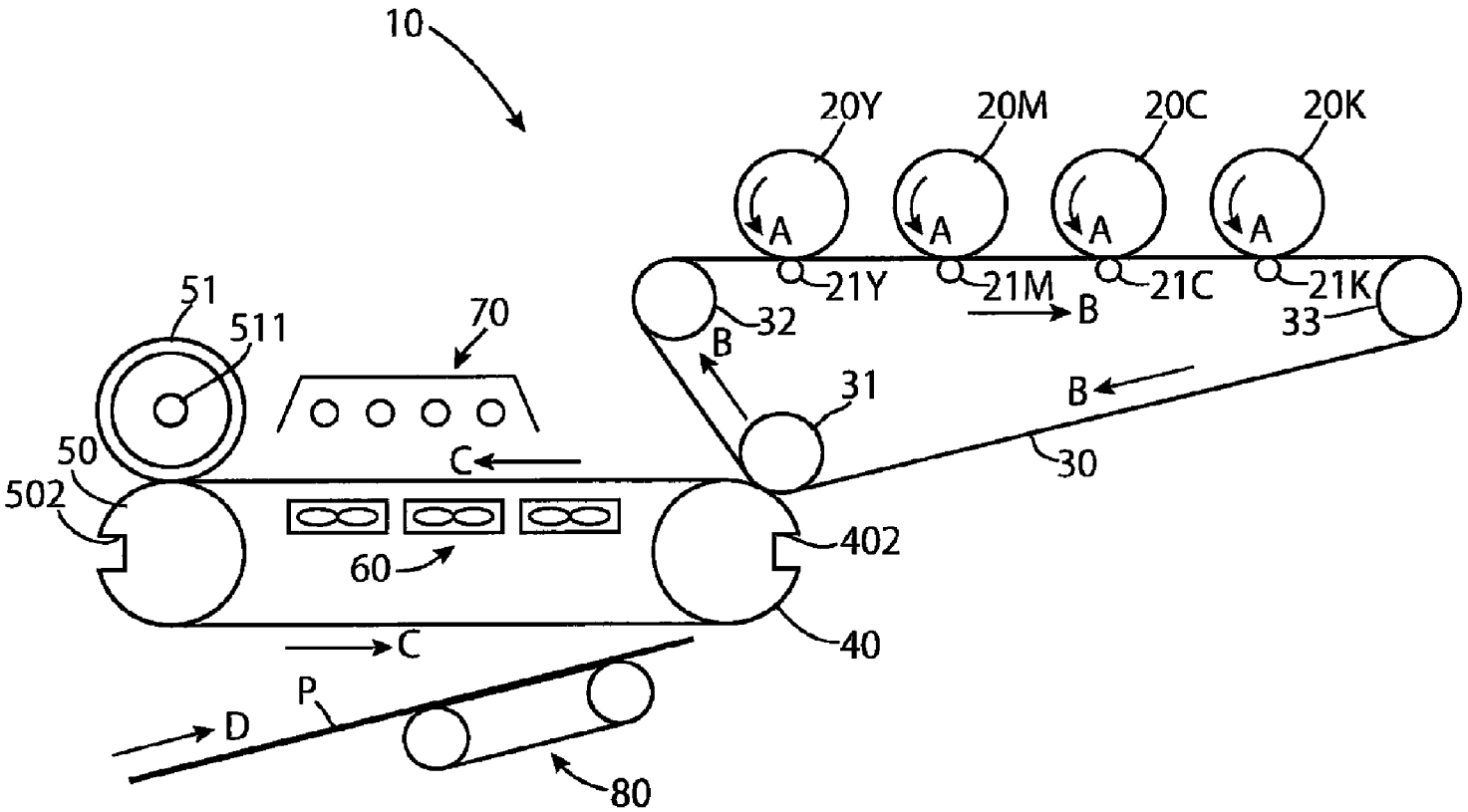
FIG. 1 is a schematic diagram showing an outline of an image forming device according to one exemplary embodiment of the present disclosure.

FIG. 1 is a schematic diagram showing an outline of an image forming device according to one exemplary embodiment of the present disclosure. The image forming device includes a transfer device and a jacket according to one exemplary embodiment of the present disclosure. The jacket is a consumable item and is detachable.

An image forming device 10 is a type of electrophotographic image forming device that forms an image using a dry toner.

The image forming device 10 includes four image carriers 20Y, 20M, 20C, and 20K. Each of the image carriers 20Y, 20M, 20C, and 20K forms a toner image on a surface thereof while rotating in a direction of an arrow A. Here, reference numerals Y, M, C, and K among the reference numerals 20Y, 20M, 20C, and 20K of the image carriers represent colors to be formed of the toner. In the following description, the reference signs Y, M, C, and K are omitted for common description regardless of the color of the toner. The same applies to components other than the image carrier 20.

The image forming device 10 further includes an intermediate transfer belt 30. The intermediate transfer belt 30 is an endless belt wound around plural rollers 31, 32, and 33 including the secondary transfer roller 31 and circularly moves in a direction of an arrow B. The toner images formed on the image carriers 20 are sequentially transferred onto the intermediate transfer belt 30 in an overlapping manner by an action of primary transfer rollers 21.

The image forming device 10 includes a transfer cylinder 40 and a fixing cylinder 50. Here, the transfer cylinder 40 is provided at a position facing the secondary transfer roller 31 with the intermediate transfer belt 30 interposed therebetween. The fixing cylinder 50 has a rotation axis parallel to a rotation axis of the transfer cylinder 40, and is disposed at a position separated from the transfer cylinder 40 in a horizontal direction. A fan 60 and a heater 70 are disposed between the transfer cylinder 40 and the fixing cylinder 50. The transfer cylinder 40 and the fixing cylinder 50 are examples of a cylinder body.

Figure 2:
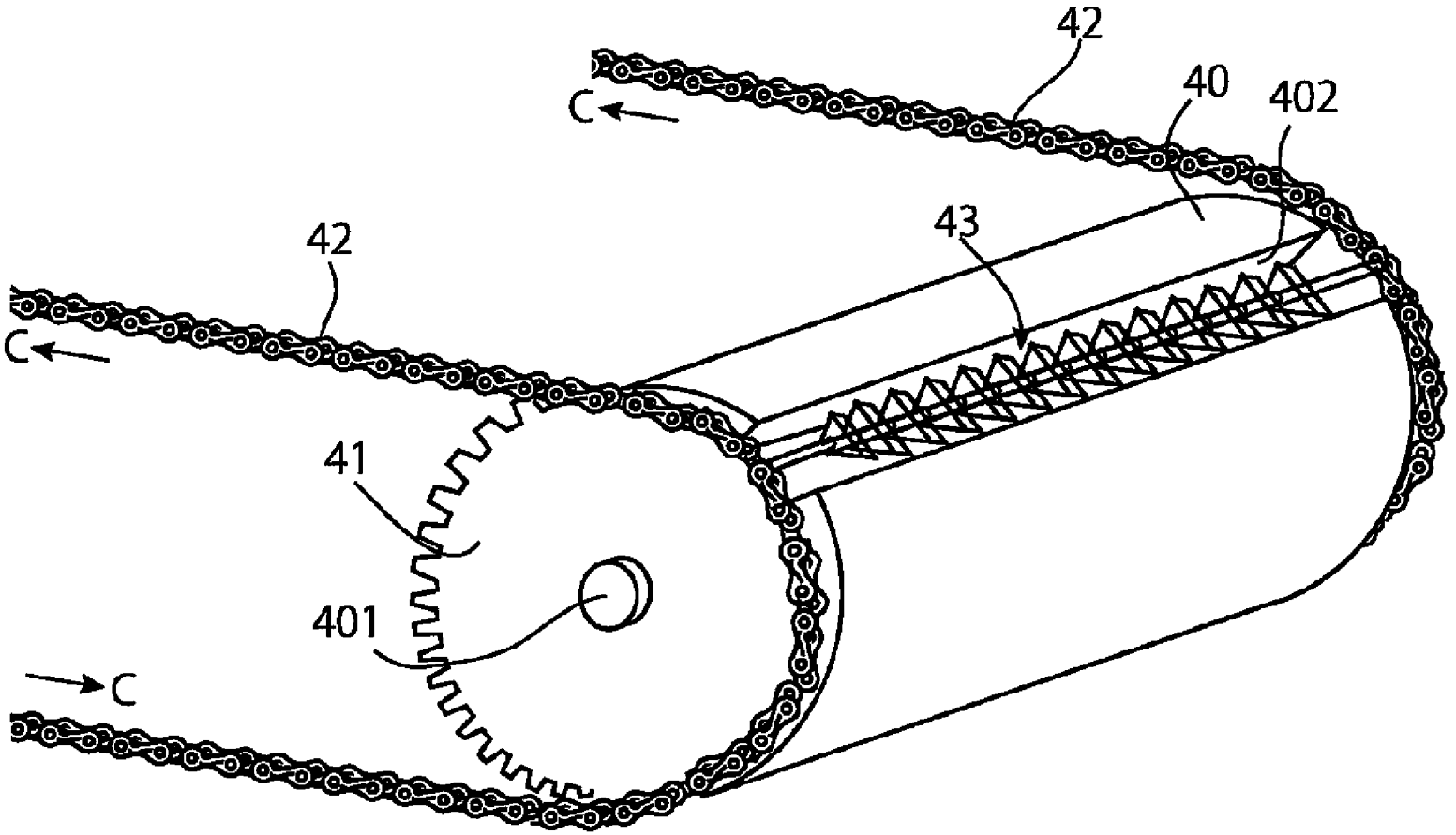
FIG. 2 is a schematic perspective view showing a periphery of a transfer cylinder.

FIG. 2 is a schematic perspective view showing a periphery of the transfer cylinder.

Gears 41 fixed to a rotation shaft 401 of the transfer cylinder 40 are provided on both sides of the transfer cylinder 40, and chains 42 mesh with the gears 41. Gears similar to those of the transfer cylinder 40 are also fixed to both sides of the rotation shaft of the fixing cylinder 50 shown in FIG. 1. Each chain 42 has an endless shape and is wound around the gear 41 of the transfer cylinder 40 and the gear (not shown) of the fixing cylinder 50. The transfer cylinder 40, the chains 42, and the fixing cylinder 50 are driven by a drive source (not shown) so that the chains 42 circulate in a direction of arrows C.

A gripper 43 is bridged between the chains 42, and both end portions of the gripper 43 are attached to the chains 42. A function of the gripper 43 will be described later. Since the gripper 43 is attached to the chains 42, when the chains 42 circulate in the direction of the arrows C, the gripper 43 moves from the transfer cylinder 40 to the fixing cylinder 50 and returns from the fixing cylinder 50 to the transfer cylinder 40 in accordance with movement of the chains 42. A groove 402 extending in the rotation axis direction is formed in the transfer cylinder 40. When the gripper 43 is located at a position overlapping the transfer cylinder 40, the gripper 43 enters the groove 402. A groove 502 (see FIG. 1) similar to the groove 402 of the transfer cylinder 40 is also formed in the fixing cylinder 50. When the gripper 43 is located at a position overlapping the fixing cylinder 50, the gripper 43 enters the groove 502.

Figure 3:
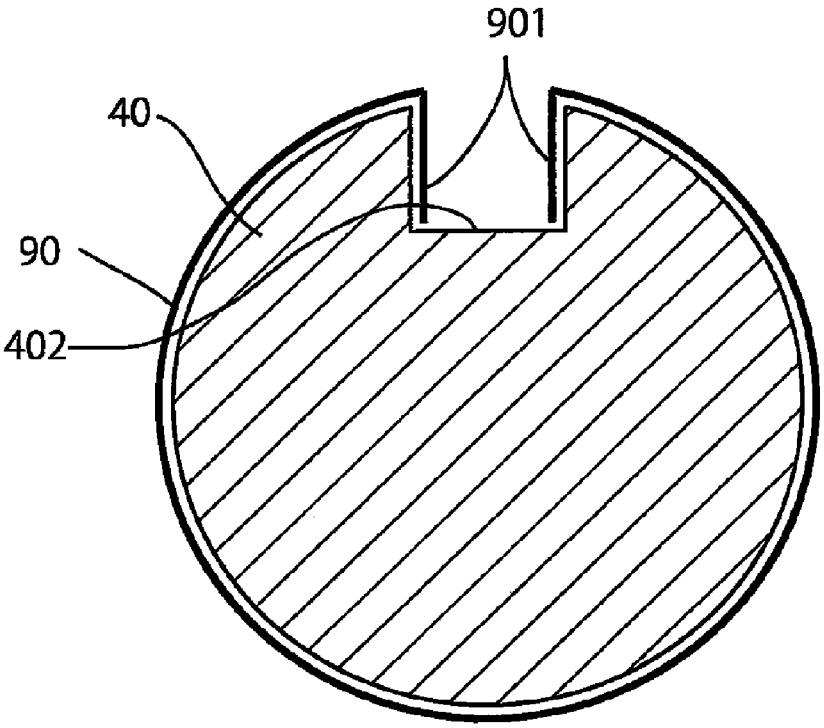
FIG. 3 is a schematic cross-sectional view of the transfer cylinder with a jacket attached, which is shown in a cross section in a plane perpendicular to a rotation shaft.

FIG. 3 is a schematic cross-sectional view of the transfer cylinder 40 with a jacket 90 attached, which is shown in a cross section taken in a plane perpendicular to the rotation axis of the transfer cylinder 40.

The jacket 90 is attached to the transfer cylinder 40. Both end portions 901 of the jacket 90 in a rotation direction of the transfer cylinder 40 are bent and enter the groove 402, and are fixed to wall surfaces of the groove 402. The transfer cylinder 40 is a conductive metal member. The jacket 90 is also conductive. The jacket 90 is a consumable item that may be replaced from time to time.

The description will be continued returning to FIGS. 1 and 2.

A sheet P is sent out from a sheet tray (not shown), transported in a direction of an arrow D by a transport device 80, and guided to the transfer cylinder 40. Phases of transport of the sheet P and rotation of the transfer cylinder 40 are synchronized with each other. A front end portion of the transported sheet P is grasped by the gripper 43. The sheet P grasped by the gripper 43 is first wound around the transfer cylinder 40 (on the jacket 90 attached to the transfer cylinder 40) in accordance with the rotation of the transfer cylinder 40 and the movement of the chains 42. A timing of the transport of the sheet P and the transfer of the toner image onto the intermediate transfer belt 30 is also adjusted. The toner image transported by the intermediate transfer belt 30 is transferred onto the sheet P in a state of being wound around the transfer cylinder 40 by the action of the secondary transfer roller 31.

The sheet P to which the toner image is transferred is transported toward the fixing cylinder 50 along with the movement of the chains 42 while the front end portion of the sheet P is grasped by the gripper 43. Here, the fan 60 is disposed below a height through which the gripper 43 passes, and has a function of sending air toward the sheet P and maintaining the sheet P in a floating state. The heater 70 is disposed above the height through which the gripper 43 passes, and preheats the sheet P and the toner image. Here, if the sheet P is not in the floating state but in a state where a lower surface thereof is in contact with a member, ways the heat is applied differs between a place where the sheet P is in contact and a place where the sheet P is not in contact, and there is a concern that unevenness may occur in the image. For this reason, here, the fan 60 is provided to send the air, and the sheet P is maintained in the floating state.

A fixing roller 51 in which a heat source 511 is disposed is provided at a position adjacent to the fixing cylinder 50. The sheet P transported to the fixing cylinder 50 while being grasped by the gripper 43 is interposed between the fixing cylinder 50 and the fixing roller 51, and is heated and pressurized, so that an image formed of a fixed toner image is formed on the sheet P. If the toner image on the sheet P is to be fixed only by the fixing cylinder 50 and the fixing roller 51 without providing the heater 70, since it is necessary to increase the heating and pressurization by the fixing cylinder 50 and the fixing roller 51, a distribution of pressurization strength in the rotation axis direction may occur, and the sheet P may be wrinkled. Therefore, here, preheating is performed by providing the heater 70.

The sheet P, on which the toner image is fixed by being interposed between the fixing cylinder 50 and the fixing roller 51 and being heated and pressurized, is released from the gripper 43 grasping the front end portion of the sheet P, and is sent out to the outside of the image forming device 10 along a transport path (not shown). On the other hand, the gripper 43 moves together with the movement of the chains 42 and returns to the transfer cylinder 40 again.

Next, a layer structure of the jacket will be described.

Figure 4:
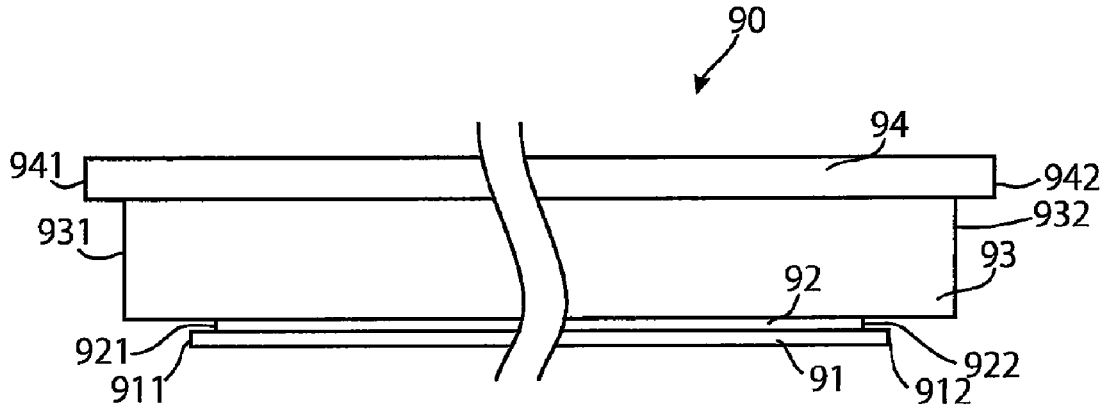
FIG. 4 is a schematic cross-sectional view of the jacket in a width direction, showing the jacket in a first example in a cross section taken along a plane extending in a rotation axis direction.

FIG. 4 is a schematic cross-sectional view of the jacket in a width direction, showing the jacket in a first example in a cross section taken along a plane extending in the rotation axis direction.

The jacket 90 has a laminated structure in which a base layer 91, an adhesive layer 92 (for example, an acrylic conductive adhesive), an elastic layer 93, and a surface layer 94 are laminated in this order. Here, in the jacket 90, the base layer 91 is a layer made of metal, and each layer is formed of a conductive material. Therefore, it is possible to form a transfer electric field by attaching the jacket 90 to the conductive transfer cylinder 40 made of metal or the like.

The base layer 91 serves to maintain a shape of the jacket 90 so that the entire jacket 90 does not extend even when the jacket 90 is attached to the transfer cylinder 40 or the jacket 90 is pressed against the secondary transfer roller 31 via the intermediate transfer belt 30. The elastic layer 93 is a layer that appropriately expands or contracts in a thickness direction when the jacket 90 is pressed against the secondary transfer roller 31 via the intermediate transfer belt 30 to smoothly transfer the toner image onto the sheet P. The surface layer 94 serves to protect the elastic layer 93.

The base layer 91 is a layer made of a thin metal plate. The base layer 91 is formed of, for example, stainless steel having a thickness of about 50 μm or copper or aluminum having a thickness of about 100 μm. The base layer 91 is a layer on a transfer cylinder 40 side when the base layer 91 is attached to the transfer cylinder 40, and corresponds to an example of a first layer according to the present disclosure. When the base layer 91 is constituted by stainless steel, corrosion resistance is excellent and corrosion is less likely to occur as compared with a case where the base layer 91 is constituted by a metal material other than stainless steel.

The elastic layer 93 is located on a side opposite to the transfer cylinder 40 via the base layer 91, is a rubber layer having a thickness of about 5 to 7 mm and has a hardness lower than that of the base layer 91. The elastic layer 93 may be a rubber layer made of foamed rubber. For example, a conductive resin material (conductive rubber layer) such as nitrile rubber, chloroprene rubber, ethylene propylene diene rubber (EPDM), acrylonitrile butadiene rubber (NBR), silicon rubber, polyurethane, polyethylene, or a mixture thereof is used for the elastic layer 93. The foamed rubber does not have good adhesion. However, in the first example, since the foamed rubber is adhered to the base layer 91 in advance, even if the elastic layer 93 is formed of the foamed rubber, the foamed rubber may be wound around the transfer cylinder 40.

The elastic layer 93 has at least one of end edges in the rotation axis direction of the transfer cylinder 40, for example, both end edges 931 and 932 in the example shown in FIG. 4, that does not exist at a position located inward of the base layer 91 in the rotation axis direction. Alternatively, at least one of end edges of the elastic layer 93 in the rotation axis direction, for example, both end edges 931 and 932 in the example shown in FIG. 4, is located at positions protruding outward from the base layer 91 in the rotation axis direction. The elastic layer 93 in FIG. 4 corresponds to an example of a second layer according to the present disclosure. Here, a thickness of the base layer 91 is smaller than a thickness of the elastic layer 93. Therefore, as compared with the case where the thickness of the base layer 91 is equal to or larger than the thickness of the elastic layer 93, even the base layer 91 having large hardness may be easily wound around the transfer cylinder 40, and workability in attachment and detachment of the jacket 90 is improved.

In the case of the jacket 90 in the first example, as described above, the base layer 91 is thinner than the elastic layer 93, and is formed of, for example, stainless steel having the thickness of about 50 μm or copper having the thickness of about 100 μm. Therefore, the end edges 911 and 912 of the base layer 91 may be sharp blades.

In the case of the jacket 90 in the first example, the base layer 91 made of metal and having high hardness does not protrude from the elastic layer 93 in the rotation axis direction. When the base layer 91 protrudes from the elastic layer 93, the workability is reduced. However, in the case of the first example, the base layer 91 does not protrude from the elastic layer 93, and therefore, even under a condition in which the base layer 91 itself may be the sharp blade, the workability when attaching and detaching the jacket 90 to and from the transfer cylinder 40 is improved.

In particular, according to the jacket 90 in the first example, since the end edges 931 and 932 of the elastic layer 93 protrude from the base layer 91 in the rotation axis direction, the workability in attachment and detachment is further improved as compared with the case where the end edges 911 and 912 of the base layer 91 and the end edges 931 and 932 of the elastic layer 93 overlap each other.

The surface layer 94 is laminated on the elastic layer 93 interposed between the base layer 91 and the surface layer 94. The surface layer 94 is made of, for example, polyimide or polyamide-imide, and has a thickness of about 80 to 100 μm. At least one of end edges of the surface layer 94 in the rotation axis direction does not exist at a position inward of the elastic layer 93 in the rotation axis direction. Further, at least one of end edges of the surface layer 94 in the rotation axis direction, for example, both end edges 941 and 942 in the case of the first example shown here, is located at a position protruding outward from the elastic layer 93 in the rotation axis direction. As described above, since the end edges 941 and 942 of the surface layer 94 do not exist at the positions inward of the elastic layer 93, it is difficult to directly touch the elastic layer 93, and the elastic layer 93 is protected by the surface layer 94. In particular, in the case of the first example, since the end edges 941 and 942 of the surface layer 94 protrude from the elastic layer 93, protection of the elastic layer 93 by the surface layer 94 is improved as compared with the case where the end edges 941 and 942 of the surface layer 94 and the end edges 931 and 932 of the elastic layer 93 overlap each other.

The adhesive layer 92 that adheres the base layer 91 and the elastic layer 93 does not exist outward from the base layer 91 in the rotation axis direction. In the case of the first example shown in FIG. 4, at least one of end edges in the rotation axis direction, specifically, both end edges 921 and 922, is located inward of the base layer 91 in the rotation axis direction. As described above, since the adhesive layer 92 does not exist outward from the base layer 91 in the rotation axis direction, the adhesive layer 92 is prevented from directly touching the transfer cylinder 40. In the case of the first example, since both end edges 921 and 922 are located inward of the base layer 91 in the rotation axis direction, the adhesive layer 92 is further prevented from directly touching the transfer cylinder 40 as compared with the case where the end edges 911 and 912 of the base layer 91 and the end edges 921 and 922 of the adhesive layer 92 overlap each other.

Next, a second example of the jacket will be described.

Figure 5:
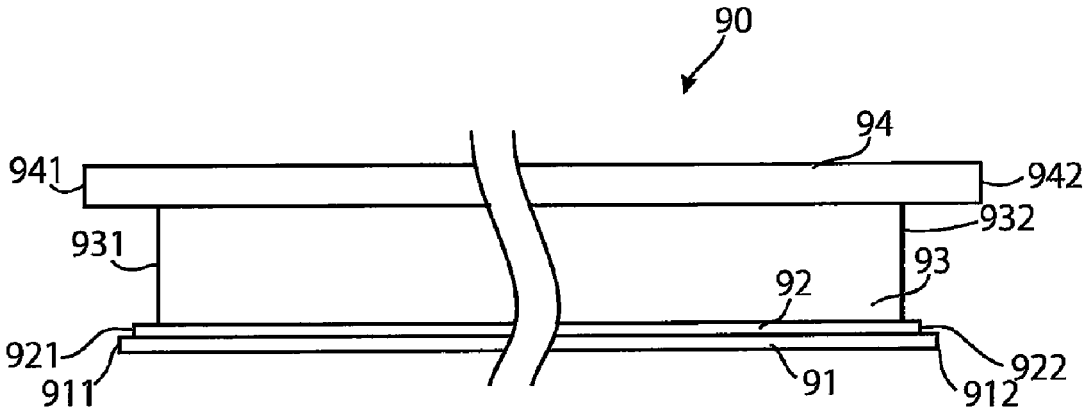
FIG. 5 is a schematic cross-sectional view of the jacket in the width direction, showing the jacket in a second example in the cross section taken along the plane extending in the rotation axis direction.

FIG. 5 is a schematic cross-sectional view of the jacket in the width direction, showing the jacket in the second example in the cross section taken along the plane extending in the rotation axis direction. Also in the second example, elements corresponding to the elements in the first example shown in FIG. 4 are denoted by the same reference numerals as those used in FIG. 4.

As in the first example, the jacket 90 in the second example has a laminated structure in which the base layer 91, the adhesive layer 92, the elastic layer 93, and the surface layer 94 are laminated in this order. Here, each layer constituting the jacket 90 is formed of the same conductive material as each layer in the first example. Therefore, it is possible to form a transfer electric field by attaching the jacket 90 to the conductive transfer cylinder 40 made of metal or the like. The thickness of each layer is the same as that in the first example.

In the case of the jacket 90 in the second example, similarly to the first example, the base layer 91 corresponds to an example of the first layer according to the present disclosure. However, in the case of the jacket 90 in the second example, unlike the first example, the surface layer 94 is regarded as an example of the second layer according to the present disclosure.

In the case of the jacket 90 in the second example, the surface layer 94, which is an example of the second layer, has at least one of end edges in the rotation axis direction of the transfer cylinder 40, for example, both end edges 941 and 942 in the example shown in FIG. 5, that does not exist at a position located inward of the base layer 91 in the rotation axis direction. Alternatively, at least one of end edges of the surface layer 94 in the rotation axis direction, for example, both end edges 941 and 942 in the example shown in FIG. 5, is located at a position protruding outward from the base layer 91 in the rotation axis direction.

In the case of the jacket 90 in the second example, similarly to the first example, the base layer 91 is formed of, for example, stainless steel having the thickness of about 50 μm or copper having the thickness of about 100 μm. Therefore, the end edges 911 and 912 of the base layer 91 may be sharp blades. In the case of the jacket 90 in the second example, the base layer 91 made of metal and having high hardness does not protrude from the surface layer 94 in the rotation axis direction. Therefore, even under the condition in which the base layer 91 itself may be the sharp blade, the workability when attaching and detaching the jacket 90 to and from the transfer cylinder 40 is improved.

Here, the elastic layer is interposed between the surface layer 94 and the base layer 91. At least one of end edges of the surface layer 94 in the rotation axis direction does not exist at a position inward of the elastic layer 93 in the rotation axis direction. Therefore, the elastic layer 93 is protected by the surface layer 94 at the end edge on the side where the end edge of the surface layer does not exist at the position inward of the elastic layer 93 in the rotation axis direction. Further, according to the second example, at least one of end edges of the surface layer 94 in the rotation axis direction, specifically, both end edges 941 and 942, is located at positions protruding outward from the elastic layer 93 in the rotation axis direction. Therefore, according to the jacket 90 in the second example, the protection of the elastic layer 93 by the surface layer 94 is improved as compared with the case where the end edges 941 and 942 of the surface layer 94 and the end edges 931 and 932 of the elastic layer 93 overlap each other in the rotation axis direction.

In the second example, regarding the adhesive layer 92 that adheres the base layer 91 and the elastic layer 93, the end edges 921 and 922 of the adhesive layer 92 in the rotation axis direction do not exist outward from the base layer 91 and do not exist inward of the elastic layer 93. Therefore, the adhesive layer 92 is prevented from directly touching the transfer cylinder 40, and the adhesive layer 92 is adhered to the base layer 91 up to the end edges 931 and 932 of the elastic layer 93 in the rotation axis direction. In the case of the second example, at least one of end edges of the adhesive layer 92 in the rotation axis direction, that is, both end edges 921 and 922 in the example shown in the second example, is located inward of the base layer 91 in the rotation axis direction and at a position protruding from the elastic layer 93. Therefore, as compared with the case where the end edges 911 and 912 of the base layer 91 and the end edges 921 and 922 of the adhesive layer 92 overlap each other, the adhesive layer 92 is further prevented from directly touching the transfer cylinder 40, and as compared with the case where the end edges 921 and 922 of the adhesive layer 92 and the end edges 931 and 932 of the elastic layer 93 overlap each other in the rotation axis direction, adhesiveness of the elastic layer 93 to the base layer 91 is further increased up to the end edges 931 and 932 of the elastic layer 93 in the rotation axis direction.

In the first and second examples described above, the adhesive layer 92 and the elastic layer 93 are laminated between the base layer 91 and the surface layer 94. However, one or plural other layers such as another elastic layer may be provided between the base layer 91 and the surface layer 94 in addition to the adhesive layer 92 and the elastic layer 93. The base layer 91 and the elastic layer 93 may be adhered to each other by thermally melting between the base layer 91 and the elastic layer 93 without providing the adhesive layer 92. In the first example described above, the surface layer 94 is laminated on the elastic layer 93, whereas the surface layer 94 may not be laminated.

As described above, in the case of the first example shown in FIG. 4, the elastic layer 93 as the second layer protrudes from the base layer 91 as the first layer in the rotation axis direction. Therefore, as compared with the case where the base layer 91 protrudes, higher workability is ensured during the work of attaching and detaching the jacket 90 to and from the transfer cylinder 40. In the case of the second example shown in FIG. 5, the surface layer 94 as the second layer protrudes from the base layer 91 as the first layer in the rotation axis direction. Therefore, as compared with the case where the base layer 91 protrudes, higher workability is ensured during the work of attaching and detaching the jacket 90 to and from the transfer cylinder 40.

Although the jacket used in the electrophotographic image forming device is described as an example, a theme of the jacket according to the present disclosure is the workability at the time of attaching and detaching. The present disclosure may be applied to a jacket used in, for example, an inkjet image forming device other than the electrophotographic image forming device. Further, the present disclosure may be applied to a jacket wound around the fixing cylinder 50.

Further, the base layer 91 as the first layer and the elastic layer 93 or the surface layer 94 as the second layer may have the same length in the rotation axis direction so that the end edge of the base layer 91 is not exposed. However, in order to more reliably prevent the end edge of the base layer 91 from being exposed, the second layer may protrude from the first layer in the rotation axis direction as in the first example shown in FIG. 4 and the second example shown in FIG. 5.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The invention claimed is:

1. A jacket comprising:

a first layer that is on a cylinder body side when the jacket is attached to a rotating cylinder body; and a second layer that is a layer located on a side opposite to the cylinder body with respect to the first layer, has a hardness lower than that of the first layer, and does not exist at a position where at least one of end edges of the cylinder body in a rotation axis direction is located inward of the first layer in the rotation axis direction.

2. The jacket according to claim 1, wherein at least one of end edges of the second layer in the rotation axis direction is located at a position protruding outward from the first layer in the rotation axis direction.

3. The jacket according to claim 1, wherein the first layer is thinner than the second layer.

4. The jacket according to claim 1, wherein the jacket is conductive, and the first layer is made of metal.

5. The jacket according to claim 2, wherein the jacket is conductive, and the first layer is made of metal.

6. The jacket according to claim 3, wherein the jacket is conductive, and the first layer is made of metal.

7. The jacket according to claim 4, wherein the second layer is a rubber layer, and the jacket further includes a surface layer that is laminated on the rubber layer interposed between the first layer and the surface layer, the surface layer configured to be in contact with a sheet, wherein at least one of end edges of the surface layer in the rotation axis direction does not exist at a position located inward of the rubber layer in the rotation axis direction.

8. The jacket according to claim 5, wherein the second layer is a rubber layer, and the jacket further includes a surface layer that is laminated on the rubber layer interposed between the first layer and the surface layer, the surface layer configured to be in contact with a sheet, wherein at least one of end edges of the surface layer in the rotation axis direction does not exist at a position located inward of the rubber layer in the rotation axis direction.

9. The jacket according to claim 6, wherein the second layer is a rubber layer, and the jacket further includes a surface layer that is laminated on the rubber layer interposed between the first layer and the surface layer, the surface layer configured to be in contact with a sheet, wherein at least one of end edges of the surface layer in the rotation axis direction does not exist at a position located inward of the rubber layer in the rotation axis direction.

10. The jacket according to claim 7, wherein at least one of end edges of the surface layer in the rotation axis direction is located at a position protruding outward from the rubber layer in the rotation axis direction.

11. The jacket according to claim 8, wherein at least one of end edges of the surface layer in the rotation axis direction is located at a position protruding outward from the rubber layer in the rotation axis direction.

12. The jacket according to claim 9, wherein at least one of end edges of the surface layer in the rotation axis direction is located at a position protruding outward from the rubber layer in the rotation axis direction.

13. The jacket according to claim 7, further comprising:

an adhesive layer that adheres the first layer and the rubber layer, wherein the adhesive layer does not exist outward from the first layer in the rotation axis direction.

14. The jacket according to claim 13, wherein at least one of end edges of the adhesive layer in the rotation axis direction is located inward of the first layer in the rotation axis direction.

15. The jacket according to claim 1, wherein the second layer is the surface layer that is in contact with the sheet, and the rubber layer is interposed between the first layer and the surface layer, and at least one of end edges of the surface layer in the rotation axis direction does not exist at the position located inward of the rubber layer in the rotation axis direction.

16. The jacket according to claim 15, wherein at least one of end edges of the surface layer in the rotation axis direction is located at a position protruding outward from the rubber layer in the rotation axis direction.

17. The jacket according to claim 15, further comprising:

an adhesive layer that adheres the first layer and the rubber layer, wherein at least one of end edges of the adhesive layer in the rotation axis direction does not exist at a position protruding from the first layer and does not exist inward of the rubber layer.

18. The jacket according to claim 17, wherein at least one of end edges of the adhesive layer in the rotation axis direction is located inward of the first layer in the rotation axis direction and at a position protruding from the rubber layer.

19. A transfer device comprising:

the cylinder body; and the jacket according to claim 1 attached to the cylinder body, wherein a transported sheet is placed on the jacket and an image is transferred onto the sheet.

20. An image forming device comprising:

the transfer device according to claim 19, wherein an image is formed on the sheet.

* * * * *